United States Patent [19]

James et al.

[11] 3,992,851

[45] Nov. 23, 1976

[54] PACKAGING APPARATUS

[75] Inventors: Robert C. James; Edward Garczynski, both of Sheboygan, Wis.

[73] Assignee: Hayssen Manufacturing Co., Sheboygan, Wis.

[22] Filed: Sept. 10, 1975

[21] Appl. No.: 611,895

[52] U.S. Cl. ..... 53/182 R

[51] Int. Cl.[2] ..... B65B 51/26; B65B 9/06

[58] Field of Search ..... 53/180 R, 182 R

[56] References Cited

UNITED STATES PATENTS

| | | | |
|---|---|---|---|
| 2,976,657 | 3/1961 | Cloud | 53/182 X |
| 3,024,581 | 3/1962 | Cloud | 53/182 X |

*Primary Examiner*—Travis S. McGehee

*Attorney, Agent, or Firm*—Koenig, Senniger, Powers and Leavitt

[57] ABSTRACT

Packaging apparatus for packaging units in flexible sheet material with the units spaced longitudinally in a tube formed of the material and with the tube sealed together between successive units. The apparatus includes a rotary sealing wheel carrying a series of sealing assemblies for sealing the tube. The sealing assemblies are uncoupled from the wheel and held at a hold position for again being released in timed relation to movement of the tube for sealing the tube between successive units. In accordance with this invention an improved center guide is provided for the sealing units so as to more precisely maintain the sealing units substantially perpendicular to the plane of the wheel and to apply a braking force to each of the sealing units so as to resist movement of the sealing units relative to the wheel.

14 Claims, 5 Drawing Figures

PACKAGING APPARATUS

BACKGROUND OF THE INVENTION

This invention relates to packaging apparatus, and more particularly to apparatus for packaging a product in a tubular bag having its ends sealed closed.

Specifically, this invention relates to an improvement in packaging apparatus as disclosed in U.S. Pat. No. 2,976,657 to Cloud in which a product to be packaged is placed on a web, and the web is formed into a tube around the product and sealed and severed in front of and behind the product to form a bag. In the above-mentioned Cloud patent, the entubed products pass around a so-called rotary turret or wheel. A plurality of clamping assemblies or die sealing units are held stationary in a rest or hold position at one location on the wheel with the wheel rotating relative to the sealing units when the latter are in their hold position. In timed relation to movement of the portions of the tube between successive products therein, the sealing units are released one at a time from the hold position and are coupled to the wheel for being driven by the wheel. Each sealing unit has a fixed lower jaw and a hinged upper jaw swingable from an open to a closed position as the sealing unit moves from the hold position so as to clamp the tube between the jaws intermediate successive products in the tube. The jaws may be heated so as to heat-seal the tube transversely across the tube. Also, the jaws may carry a severing blade (or a heated wire) for severing the tube within the seal formed by the jaws thereby to form the trailing end seal of a leading bag and the leading end seal of a trailing bag. The jaws securely grip the web as the die moves with the wheel and thus pull the tube and products therein through the apparatus at the speed of the wheel.

In the above-mentioned U.S. Pat. No. 2,976,657, the sealing units are maintained in their sealing position substantially perpendicular to the plane of the wheel by means of rollers riding in grooves spaced from the outer edges of the sides of the wheel and extending circumferentially thereround. However, due to the clearance required for rotation of the rollers in their grooves, the sealing units may cock or cant with respect to the plane of the wheel. This cooking or canting of the sealing units results in bags having oblique end seals, and in some instances, results in the sealing units becoming locked to the wheel.

Other packaging apparatus similar to the above-described apparatus are known which utilize another arrangement for coupling and uncoupling the sealing units to the wheel. This other coupling arrangement comprises a bar extending from side-to-side of the sealing unit movable generally in the direction of rotation of the wheel between an uncoupled position in which it is clear of the periphery of the wheel and a coupled position in which it is wedged between an inclined portion of the sealing unit and the outer edge of the wheel thereby to lock the sealing unit to the wheel for rotation therewith. This arrangement is effective for locking the sealing unit to the wheel to prevent movement of the sealing unit in the direction opposite the rotation of the wheel. However, this locking arrangement does not prevent the sealing unit from moving relative to the wheel in the direction of rotation of the wheel. Upon the release of the sealing unit from the hold position, the sealing unit becomes coupled to the wheel and moves with the wheel over the top of the wheel. As the sealing unit moves down from the top of the wheel and before it is engaged by a sealing unit closing cam, the unit is free to fall forward in the direction of rotation of the wheel at a speed faster than the surface speed of the wheel. In known prior art apparatus, brake pads are provided at the ends of each sealing unit engageable with each side of the wheel for applying a braking force to the sealing unit so as to prevent it from falling forward and downward from the top of the wheel at a speed faster than the rotational speed of the wheel. However, with the brakes at the sides of the sealing unit, unequal braking forces may be applied to the sealing unit which may cause the sealing unit to cant or cock relative to the wheel.

SUMMARY OF THE INVENTION

Among the several objects of this invention may be noted the provision of improved packaging apparatus, such as described above, which substantially eliminates canting or cocking of the sealing units with respect to the rotational plane of the wheel; the provision of such apparatus which prevents the sealing units from moving relative to the wheel in the direction of rotation thereof; and the provision of such apparatus which is of simple and rugged construction and which is reliable in operation. Other objects and features of this invention will be in part apparent and in part pointed out hereinafter.

Briefly, apparatus of this invention packages units in flexible sheet material, with the units prior to being packaged being spaced longitudinally in a tube of the material. The apparatus has means for sealing the tube between the units, this sealing means comprising a wheel rotatable on an axis and a series of sealing units carried by the wheel. Each sealing unit has means for coupling it to the wheel for travel therewith and for uncoupling it from the wheel to allow the wheel to rotate while the sealing unit remains stationary. The wheel has a pair of spaced side members engageable by the coupling means for coupling the sealing units to the wheel and for movement of the sealing units with the wheel, and a guide member between the side members rotatable with the wheel. Each sealing unit further has means engageable with the guide member for substantially limiting angular movement of each sealing unit with respect to the plane of the wheel and for substantially preventing movement of the sealing unit relative to the wheel in the direction of rotation of the wheel.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
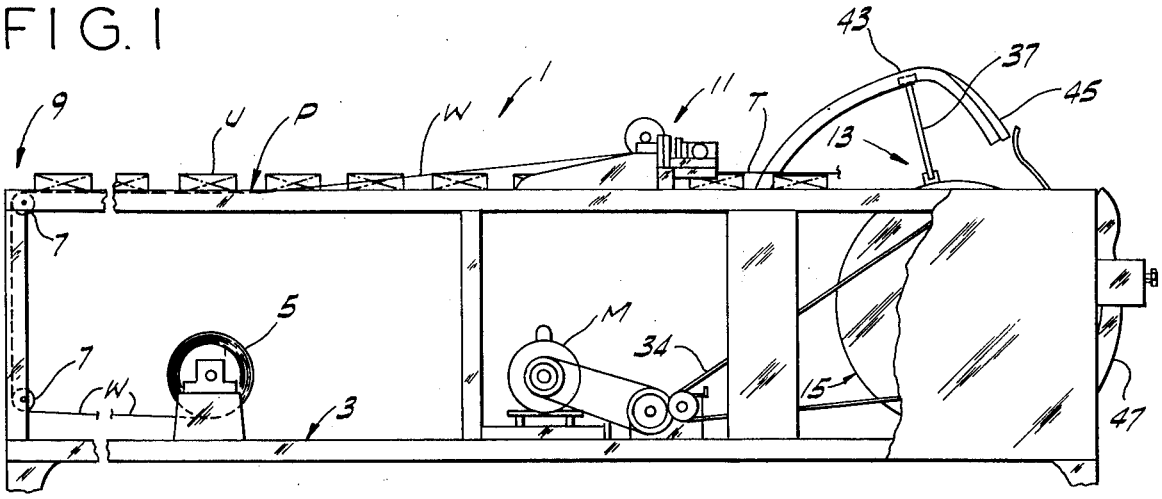
FIG. 1 is a simplified side elevational view of apparatus of this invention with some parts broken away or omitted to illustrate key components and operation of the apparatus.

Referring now to the drawings, packaging apparatus 1 of this invention is shown to comprise a frame 3 for supporting a roll 5 of flexible web material W, such as heat-sealable plastic film, heat-sealable laminate sheet material, or the like. The web travels over rollers 7 along a path P through the apparatus. More particularly, web W moves past a loading station 9 at which point units U are fed onto the upper face of the web at substantially equal longitudinal intervals along the web by an infeed conveyor (not shown). As indicated at 11, means is provided along the path P forming the web into a tube T surrounding the units. This tube forming means folds up the side margins of the web on the units and forms a continuous longitudinal back seal joining the side margins of the web. The tube with the units U therein is moved along its path P toward means generally indicated at 13 for sealing and severing the tube between successive units U at package length intervals thereby to form a sealed bag around each unit.

Figure 2:
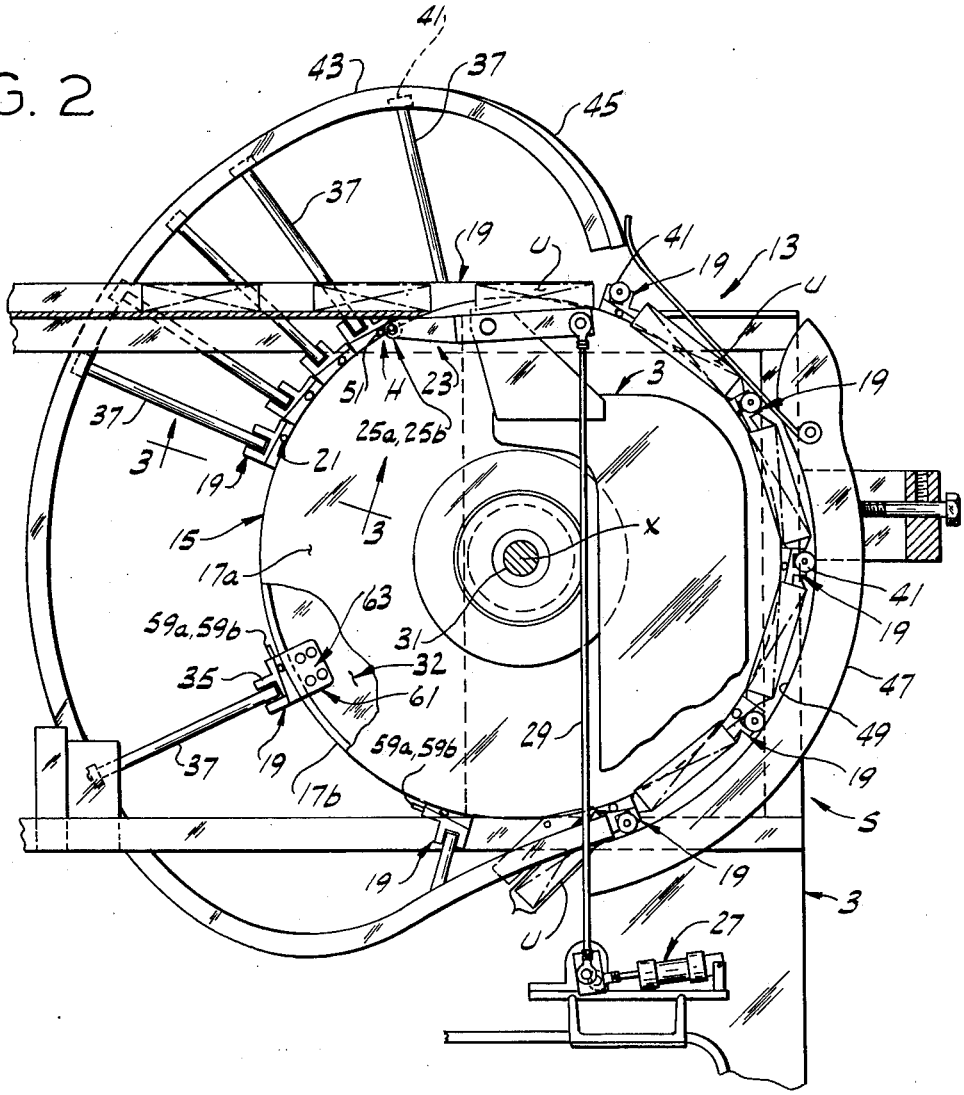
FIG. 2 is an enlarged view of a portion of the apparatus shown in FIG. 1 with some parts broken away to illustrate a wheel having spaced side plates, a guide ring carried by the wheel between the side plates, and plurality of sealing units movable with the wheel.

More particularly, sealing means 13 comprises a wheel 15 rotatable on a horizontal axis X and having two spaced, circular side plates 17*a*, 17*b*. The sealing means further comprises a series of sealing assemblies or units, each sealing unit being indicated at 19, carried by the wheel. Each sealing unit 19 has means 21 (see FIGS. 2–5) for coupling it to both side plates 17*a*, 17*b* of wheel 15 for travel with the wheel and for uncoupling it from the wheel to allow the wheel to rotate relative to the sealing unit while the sealing unit remains stationary. As indicated at 23, means is provided for arresting a first sealing unit 19 at a hold position H and actuating its coupling means 21 to uncouple it from the wheel. Successive sealing units 19 trailing the first unit are arrested by interengagement behind the arrested unit, and the coupling means thereof are actuated to uncouple the successive sealing units from wheel 15. As shown in FIG. 2, arresting means 23 comprises a pair of stops 25*a*, 25*b*, one at each side of the wheel, movable between an operative position (as shown in FIG. 2) wherein the stops are engageable by coupling means 21 of the first sealing unit at hold position H to simultaneously uncouple this first sealing unit from both side plates 17*a*, 17*b* of wheel 15, and a retracted position for release of the sealing unit to travel with the wheel and for simultaneously coupling it to both sides of the wheel. A single cylinder actuator unit 27 is provided for stops 25*a*, 25*b*, and a linkage arrangement, generally indicated at 29, interconnects actuator cylinder unit 27 and stops 25*a*, 25*b* for simultaneous movement of the stops between their operative and retracted positions.

More particularly, wheel plates 17*a*, 17*b* are spaced apart a distance somewhat greater than the maximum width of units U which can be packaged by apparatus 1. The plates are secured to a shaft 31 which is journalled by frame 3. A circular guide member or ring 32 positioned equidistant between the side plates is secured to shaft 31 and is rotatable with the wheel. This ring is constituted by a disk parallel to the side plates in the central plane of the wheel concentric with axis X—X. Each side plate has a respective groove 33*a*, 33*b* in its inner face adjacent its periphery (see FIG. 3). Wheel 15 is rotatably driven by a motor M via a chain and sprocket drive assembly 34.

Figure 3:
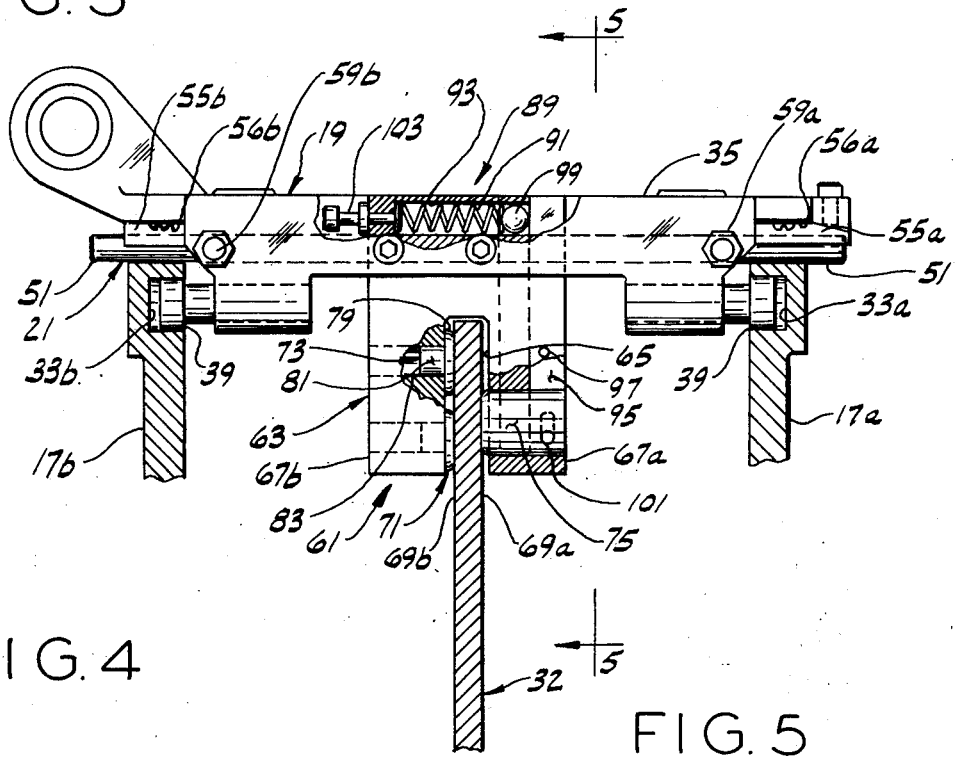
FIG. 3 is an enlarged cross-sectional view taken on line 3—3 of FIG. 2 illustrating a sealing unit with its upper jaw omitted.
Figure 4:
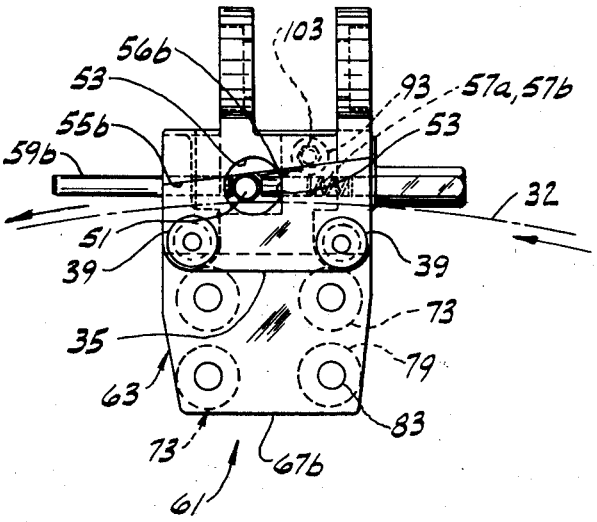
FIG. 4 is a left end elevational view of FIG. 3.
Figure 5:
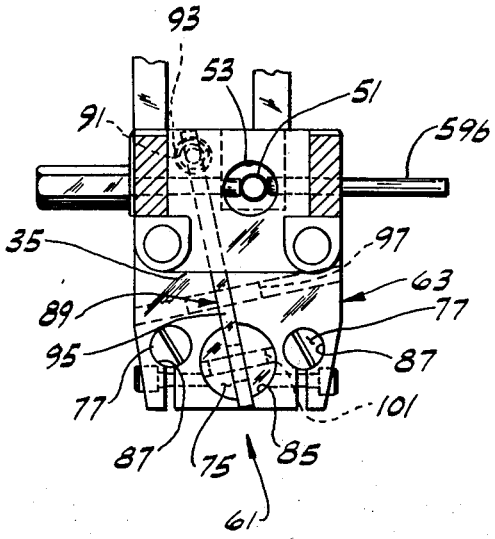
FIG. 5 is a vertical cross-sectional view taken on line 5—5 of FIG. 3.

As shown in FIGS. 3–5, each sealing unit 19 includes a base 35 extending laterally between and beyond wheel plates 17*a*, 17*b*, this base constituting a fixed or lower sealing jaw and hingedly carrying an upper sealing jaw 37 (see FIGS. 1 and 2) swingable between an open position (e.g., the position of the upper jaws of sealing units 19 in hold position H) and a closed position (e.g., the position of the upper jaws of sealing units at the right side of wheel 15 in FIG. 2) in which the jaws clamp tube T therebetween. As disclosed in the heretoforementioned U.S. Pat. No. 2,976,657, the jaws may be heated for heat-sealing the tube and may carry blades (not shown) for severing the tube between successive units U. With the jaws closed and clamped to the tube and with the sealing units positively coupled to the wheel 15, the sealing units pull web W and tube T along path P through the apparatus as the sealing units rotate with the wheel through a sealing zone S. As shown in FIG. 2, more than one sealing unit grips the tube at any one time and thus the tube is continuously conveyed along its path P at substantially the surface speed of the sealing units carried by wheel 15.

More particularly, base 35 of each sealing unit 15 has a pair of rollers at each side thereof, each of these rollers being indicated at 39, received in grooves 33*a*, 33*b* in wheel plates 17*a*, 17*b*. These rollers transmit substantial clamping forces from the base to wheel 15 as sealing units 19 pass through sealing zone S and also permit movement of wheel 15 relative to the sealing units when the latter are arrested at hold position H. A cam roller 41 (see FIG. 2) is carried by the outer end of movable jaw 37. These rollers are received in a guide track 43 when sealing units 19 are in their hold position to hold the jaws open. The guide track has a cam closing portion 45 which closes the jaws of each sealing unit as the latter is released from hold position H and as it travels with the wheel toward sealing zone S. an arc-shaped pressure cam 47 is spaced from the outer periphery of wheel 15 and extends around a portion of the wheel. The length of pressure cam 47 generally defines sealing zone S. The pressure cam has a cam surface 49 engageable with cam rollers 41 to firmly hold jaw 37 closed on its fixed jaw 35 thereby to positively grip tube T and to seal the tube as heretofore described. At the trailing end of the pressure cam, cam rollers 41 engage guide track 43 and as the cam rollers exit the pressure cam, the upper jaw of each sealing unit is positively opened by the guide track (see FIG. 2) and the packaged unit U drops free of wheel 15 onto an outfeed conveyor (not shown).

As shown in FIGS. 3–5, each sealing unit base 35 has a coupling bar 51 extending laterally of the sealing unit out beyond the lateral ends of the sealing unit and beyond side plates 17*a*, 17*b* of wheel 15. This coupling bar is received within an enlarged bore 53 in base 35. At each side of base 35 an inclined ramp 55*a*, 55*b* is spaced radially outwardly of the outer peripheral surface of wheel plates 17*a*, 17*b* with the end of this inclined ramp surface toward the direction of movement of wheel 15 being spaced from the outer periphery of the wheel a distance somewhat less than the thickness of coupling bar 51. A resilient flat spring 56*a* or 56*b* is provided on the downwardly facing surface of respective ramps 55*a*, and 55*b* for resiliently biasing the coupling bar into engagement with the outer peripheral surfaces of wheel side plates 17*a*, 17*b*. Compression coil springs 57*a*, 57*b* at opposite lateral ends of base 35 bias coupling bar 51 in the direction of rotation of the wheel toward a coupled position (see FIG. 4) in which the coupling bar is wedged between the outer peripheral surfaces of wheel plates 17*a*, 17*b* and springs 56*a*, 56*b* thereby to lock the sealing unit to the wheel. The coupling bar is movable against the bias of springs 57*a*, 57*b* to an uncoupled position in which the coupling bar is free of the peripheral surfaces of wheel plates 17*a*, 17*b* thereby to uncouple the sealing unit from the wheel. Coupling bar 51 carries a pair of interengagement pins 59*a*, 59*b* which are received in apertures in base 35 and which project out beyond the forward end of the base for interengagement with a previously arrested sealing unit 19 at hold position H as the sealing unit enters the hold station. Upon interengagement with the next adjacent sealing unit, pins 59*a*, 59*b* move coupling bar 51 from its coupled to its uncoupled position thereby to effect uncoupling of the sealing unit in its hold position.

In accordance with this invention, each sealing unit 19 has means, as generally indicated at 61, engageable with guide ring 32 for substantially limiting angular movement of the sealing unit with respect to the plane of wheel 15 and for resisting movement of the sealing unit relative to the wheel. In other words, means 61 acts as a guide to substantially eliminate cocking or canting of the sealing unit relative to the wheel and has a brake to prevent the sealing unit from moving (i.e., falling) from the top of the wheel toward sealing zone S in the direction of rotation of the wheel at a speed greater than the rotational speed of the wheel.

More particularly, means 61 is shown to comprise a caliper 63 carried by body 35 of each sealing unit 19 at the center thereof between side plates 17*a*, 17*b* of the wheel. Caliper 63 has an opening or slot 65 therein for reception of a segment of the outer margin of ring 32 with caliper portions 67*a*, 67*b* spaced from one another on opposite sides of the wheel and thus defining slot 65, the inner faces of these caliper portions facing a respective adjacent face 69*a*, 69*b* of ring 32. As indicated at 71, caliper 63 carries means in its caliper portions 67*a*, 67*b* for frictional engagement with faces 69*a*, 69*b* of the ring. This frictional engagement means is shown to include a plurality of (e.g., four) contact pads 73 carried by caliper portion 67*b* engageable with ring 69*b*, a brake pad 75 carried by the opposite caliper portion 67*a* engageable with face 69*a* of ring 32, and a pair of contact pads 77 also carried by caliper portion 67*a*. Contact pads 77 are shown to be located on opposite sides of brake pad 75 and are also frictionally engageable with face 69*a* of a ring 32. As best shown in FIG. 3 each contact pad 73 has an enlarged head 79 and a body 81. Caliper portion 67*b* has four apertures 83 therethrough. Bodies 81 of contact pads 73 are insertable in apertures 83 and have a relatively tight fit therein to securely hold the contact pads in place on the caliper portion 67*b*. Apertures 83 are shown to be spaced on caliper portion 67b in a rectangular arrangement so that at least two of the contact pads are spaced laterally along the ring from one another. With this arrangement, the outer edges of the contact pads are spaced apart in circumferential direction of the ring a maximum distance for a given size of caliper 63.

Caliper portion 67*a* has a bore 85 therein generally perpendicular to the plane of ring 32. Brake pad 75 is received is this bore and is movable therein toward and away from the ring. On both sides of bore 85, threaded apertures 87 are provided (see FIG. 5). Each contact pad 77 is threaded in a respective aperture 87 and thus may be threadably adjusted to frictionally engage face 69*a* of ring 32. Preferably contact pads 73 and 77 are of a synthetic resin bearing material, such as nylon, TFE, or the like, which has a relatively low sliding coefficient of friction. Brake pad 75 is of a suitable brake pad material which has a coefficient of sliding friction appreciably higher than contact pads 73 and 77.

Brake pad 75 is biased toward engagement with face 69*a* of ring 32 by means as generally indicated at 89. This means includes a compression coil spring 91 received in a bore 93 in body 35 above caliper 63. A lever 95 is pivoted intermediate its ends, as indicated at 97, to caliper 63 between bores 85 and 93. A ball roller 99 is interposed between one end of spring 91 and one end of lever 95, and the other end of the lever is connected to brake pad 75 by means of a slot and pin connection 101 (see FIG. 3). The other end of spring 91 is engageable by an adjustment screw 103 carried by body 35, this adjustment screw being operable to compress or unload spring 91 and to thus vary the biasing force exerted on pad 75 by the spring. With spring 91 applying an inward biasing force to brake pad 75 and with the latter in frictional engagement with ring 32, a braking force is transmitted to each sealing unit 19 in the event the sealing unit moves relative to the wheel. In addition to preventing the sealing units from falling forward from the top of wheel 15 as heretofore described, this braking force also biases the sealing units 19 at hold station H toward stops 25*a*, 25*b* and thus serves to hold the sealing units in interengagement with one another so as to hold their coupling bars 51 in their respective uncoupled positions.

In prior art sealing units, the stability of the sealing unit carried by the wheel depended on the spacing of rollers analogous to rollers 39 of the present invention from one another on each side of the sealing unit, the distance the rollers at each side of the sealing unit are spaced from one another (which is approximately the distance between the side plates of the wheel), and the clearance provided for the rollers in the grooves (like grooves 33*a*, 33*b*). In the sealing units 19 of the present invention contact pads 73 and 77 on opposite sides of ring 32 are adjusted to be in continuous sliding contact with the ring. Also, these contact pads are widely spaced from one another along each face of ring 32 in relation to the spacing of the contact pads carried by caliper portions 67*a*, 67*b* (i.e., the thickness of ring 32). Thus, cocking and canting of the sealing unit with respect to the ring (i.e., to the rotational plane of wheel 17) is substantially eliminated. Also, with brake pad 75 at the center of this sealing unit and being engageable with ring 32 at a single point on the sealing unit, the braking force applied to the sealing unit is applied only at one location at the center of the unit and thus substantially prevents canting and cocking of the unit with respect to the plane of the wheel.

In view of the above, it will be seen that the several object of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus for packaging units in flexible sheet material wherein the units are spaced logitudinally in a tube of said material and the apparatus has means for sealing the tube between the units, said sealing means comprising a wheel rotatable on an axis and a series of sealing units carried by the wheel, each sealing unit having means for coupling it to the wheel for travel therewith and adapted for uncoupling of the sealing unit from the wheel to allow the wheel to rotate while the sealing unit remains stationary, said wheel having a pair of spaced side members engageable by said coupling means for coupling said sealing units to the wheel and for movement of the sealing units with the wheel and a guide member between the side members rotatable with the wheel, each said sealing unit further having means engageable with said guide member for substantially limiting angular movement of each said sealing unit with respect to the plane of the wheel and for resisting movement of each said sealing unit relative to said wheel.

2. Apparatus as set forth in claim 1 wherein said guide member comprises a circular member secured to said wheel concentric with the wheel, and wherein said means engageable with said guide member comprises portions of each said sealing unit disposed on opposite sides of said circular members, said portions having means for engaging said circular member.

3. Apparatus as set forth in claim 2 wherein said engaging means comprises a plurality of contact pads carried by said portions of each said sealing unit on each side of said circular member for sliding engagement therewith.

4. Apparatus as set forth in claim 3 further including means for adjusting said pads on one of said sealing unit portions toward and away from said circular member to insure that said pads on both sides of said portions are in sliding contact with said circular member.

5. Apparatus as set forth in claim 3 wherein said engaging means further comprises brake means carried by one of said sealing unit portions engageable with said circular member.

6. Apparatus as set forth in claim 5 wherein said brake means includes a brake pad and means for biasing said brake pad toward engagement with one side of said circular member for maintaining a braking force on each said sealing unit.

7. Apparatus as set forth in claim 6 further comprising means for adjusting said biasing means so as to selectively vary said braking force.

8. Apparatus as set forth in claim 1 wherein said guide member is a circular member secured to said wheel in the central plane of said wheel between the side members of the wheel, and wherein each said sealing unit comprises a main body extending from side-to-side of the wheel generally perpendicular to the plane of the wheel, said body having a caliper portion with a slot therein for reception of a portion of the outer margin of said circular member, one side of said caliper portion having a plurality of contact pads slidably engageable with an adjacent face of said circular member, at least two of said contact pads being spaced from one another laterally of said circular member, the other side of said caliper portion having a brake pad engageable with the other side of said circular member for application of a braking force to each said sealing unit upon relative moving the sealing unit and the wheel.

9. Apparatus as set forth in claim 8 wherein each said sealing unit further comprises a pair of contact members carried by said other side of said caliper portion, one on each side of said brake pad, for engagement with the other face of said circular member, each said sealing unit including means for adjustably moving said contact members toward and away from said circular member so as to insure that said contact members and said contact pads are in sliding contact with said circular member thereby to hold said sealing unit substantially perpendicular with respect to the plane of the wheel and to substantially eliminate angular movement of said sealing unit with respect to the plane of the wheel.

10. Apparatus as set forth in claim 8 wherein each said sealing unit comprises means for biasing said brake pad toward engagement with said circular member.

11. Apparatus as set forth in claim 10 wherein said biasing means comprises a spring carried by said body, and a lever pivotally secured to said body having one portion thereof engagable by said spring having another portion thereof in engagement with said brake pad whereby said spring biases said pad toward said circular member.

12. Apparatus as set forth in claim 11 wherein said one side of said caliper portion has a bore therein extending generally perpendicular to said circular member, said brake pad being received in said bore and being movable toward and away from said circular member, said body having another bore therein for reception of said spring, said lever being pivotally secured to said body intermediate its ends with one of its ends being engageable by said spring and with its other end being interconnected to said brake pad.

13. Apparatus as set forth in claim 12 wherein said biasing means further comprises means for adjusting the force said spring exerts on said brake pad via said lever.

14. Apparatus for packaging units in flexible sheet material wherein the units are spaced longitudinally in a tube of said material and the apparatus has means comprising a wheel rotatable on an axis and a series of sealing units carried by the wheel, each sealing unit having means for coupling it to the wheel for travel therewith and adapted for uncoupling of the sealing unit from the wheel to allow the wheel to rotate while the sealing unit remains stationary, said wheel having a pair of spaced side members engageable by said coupling means for coupling said sealing units to the wheel and for movement of the sealing units with the wheel and a guide member between the side members rotatable with the wheel, each said sealing unit further having means engageable with said guide member for substantially limiting angular movement of each said sealing unit with respect to the plane of the wheel and for preventing movement of each said sealing unit at a speed faster than the speed of the wheel.

* * * * *